US008375902B2

(12) United States Patent
Berger et al.

(10) Patent No.: US 8,375,902 B2
(45) Date of Patent: Feb. 19, 2013

(54) AIR SPRING WITH CAP

(75) Inventors: Christian Berger, Offenhausen (AT); Johann Neuboeck, Gunskirchen (AT); Roland Ennsmann, Wels (AT); Walter Hinterberger, Grieskirchen (AT); Stefan Leiber, Marchtrenk (AT)

(73) Assignee: BRP-Powertrain GmbH & Co. KG, Gunskirchen (AT)

( * ) Notice: Subject to any disclaimer, the term of this patent is extended or adjusted under 35 U.S.C. 154(b) by 412 days.

(21) Appl. No.: 12/690,528

(22) Filed: Jan. 20, 2010

(65) Prior Publication Data

US 2010/0181515 A1 Jul. 22, 2010

Related U.S. Application Data

(60) Provisional application No. 61/146,519, filed on Jan. 22, 2009.

(51) Int. Cl.
*F01L 9/02* (2006.01)

(52) U.S. Cl. ..... 123/90.14; 123/90.1; 123/90.38; 123/90.65

(58) Field of Classification Search ..... 123/90.14, 123/90.1, 90.38, 90.65
See application file for complete search history.

(56) References Cited

U.S. PATENT DOCUMENTS

| | | | |
|---|---|---|---|
| 1,695,011 | A | 12/1928 | Fornaca |
| 3,120,221 | A | 2/1964 | Lyons |
| 4,592,313 | A | 6/1986 | Speckhart |
| 4,674,462 | A | 6/1987 | Koch et al. |
| 5,058,541 | A | 10/1991 | Shibata et al. |
| 5,233,950 | A | 8/1993 | Umemoto et al. |
| 5,553,572 | A | 9/1996 | Ochiai |
| 5,586,529 | A | 12/1996 | Vallve |
| 5,664,527 | A | 9/1997 | Boudy |
| 6,083,140 | A | 7/2000 | Kimura |
| 6,148,780 | A | 11/2000 | O'Neill et al. |
| 6,568,970 | B2 | 5/2003 | Berthiaume et al. |
| 6,745,738 | B1 | 6/2004 | Bosscher |
| 2003/0075143 | A1 | 4/2003 | Hallam |
| 2005/0217619 | A1 | 10/2005 | Martinez |
| 2009/0007863 | A1 | 1/2009 | Matsuda |

FOREIGN PATENT DOCUMENTS

| | | | |
|---|---|---|---|
| CH | 671808 | | 9/1989 |
| DE | 10113095 | A1 | 9/2002 |
| DE | 10207038 | A1 | 8/2003 |
| EP | 0396327 | B1 | 12/1992 |
| EP | 0646700 | B1 | 3/1999 |

(Continued)

OTHER PUBLICATIONS

Search Report from EP 10 15 1100 dated May 3, 2010; Munich.

(Continued)

*Primary Examiner* — Ching Chang
(74) *Attorney, Agent, or Firm* — BCF LLP

(57) ABSTRACT

A poppet valve has a valve head and a valve stem. A piston is capable of reciprocating motion relative to a housing along a reciprocation axis. The piston has a valve-receiving portion for receiving therein an end portion of the valve stem. A cotter secures the valve stem to the piston. A cap is disposed around the valve-receiving portion. A cap lateral portion extends away from the cap end portion in the direction of the valve head. The valve-receiving portion is held between the cap end portion and the cap lateral portion in a direction parallel to the reciprocation axis. At least part of the cap lateral portion is angled toward the reciprocation axis. The part of the cap lateral portion is closer to the reciprocation axis than at least part of the valve-receiving portion. A method of assembling a valve assembly is also described.

13 Claims, 8 Drawing Sheets

FOREIGN PATENT DOCUMENTS

| | | | |
|---|---|---|---|
| EP | 0697540 | B1 | 9/1999 |
| EP | 0824180 | B1 | 5/2001 |
| EP | 0722043 | B1 | 10/2001 |
| EP | 1143115 | B1 | 1/2004 |
| FR | 569131 | A | 4/1924 |
| FR | 2529616 | B1 | 3/1987 |
| GB | 392294 | | 5/1933 |
| GB | 2102065 | A | 1/1983 |
| JP | 63009609 | A2 | 1/1988 |
| JP | 2230909 | A2 | 9/1990 |
| JP | 2283806 | A2 | 11/1990 |
| JP | 2294506 | A2 | 12/1990 |
| JP | 3194103 | A2 | 8/1991 |
| JP | 5039704 | A2 | 2/1993 |
| JP | 5052103 | A2 | 3/1993 |
| JP | 5059916 | A2 | 3/1993 |
| JP | 5079307 | A2 | 3/1993 |
| JP | 6159024 | A2 | 6/1994 |
| JP | 6248912 | A2 | 9/1994 |
| JP | 10288012 | A2 | 10/1998 |
| JP | 2003222011 | A2 | 8/2003 |
| JP | 2007309176 | | 11/2007 |

OTHER PUBLICATIONS

English abstract of DE 102 07 038.
English translation of French patent No. 569 131.
F1 Engine Power Secrets [online], Jun. 2000, [retrieved on Jun. 1, 2009]. Retrieved from the Internet: < URL: http://www.pureluckdesign.com/ferrari/f1engine>.
Valve System Image [online], [retrieved on Jun. 1, 2009]. Retrieved from the Internet: < URL: http://www.pureluckdesign.com/ferrari/f1engine/valvesystem1.jpg>.
English Abstract of JP2007309176.
English Abstract of JP63009609.
English Abstract of JP6159024.
English Abstract of JP5079307.
English Abstract of JP5059916.
English Abstract of JP2230909.
English Abstract of JP2003222011.
English Abstract of JP10288012.
English Abstract of DE10113095.
English Abstract of EP0824180.
English Abstract of EP1143115.
English Abstract of JP6248912.
English Abstract of JP5052103.
English Abstract of JP5039704.
English Abstract of JP3194103.
English Abstract of JP2294506.
English Abstract of JP2283806.
English Abstract of FR2529616.
English Abstract of EP0697540.
English Abstract of CH671808.

AIR SPRING WITH CAP

CROSS-REFERENCE

The present application claims priority to U.S. Provisional Patent Application No. 61/146,519, filed Jan. 22, 2009, the entirety of which is incorporated herein by reference.

FIELD OF THE INVENTION

The present invention relates to an air spring arrangement for an internal combustion engine.

BACKGROUND OF THE INVENTION

Many internal combustion engines, such as engines operating on the four-stroke principle, have intake and exhaust valves provided in the cylinder head of the engine. The intake valves open and close to selectively communicate the air intake passages of the engine with the combustion chambers of the engine. The exhaust valves open and close to selectively communicate the exhaust passages of the engine with the combustion chambers of the engine.

To open the valves, many engines are provided with one or more camshafts having one or more cams provided thereon. The rotation of the camshaft(s) causes the cam(s) to move the valves to an opened position. Metallic coil springs are usually provided to bias the valves toward a closed position.

Although metallic coil springs effectively bias the valves toward their closed positions for most engine operating conditions, at high engine speeds, the metallic coil springs have a tendency to resonate. When resonating, the metallic coil springs cause the valves to vacillate between their opened and closed positions, which, as would be understood, causes the intake and exhaust passages inside which the valves are connected to be opened when they should be closed. This results in a reduction of operating efficiency of the engine at high engine speeds.

One solution to this problem consists in replacing the metallic coil springs with air springs. An air spring typically consists of a cylinder having a piston therein. An air chamber is defined between the cylinder and the piston. The valve (intake or exhaust) is connected to the piston of the air spring using a cotter. A spacer, in the form of a shim, is disposed between the valve and the cam to ensure that the valve seats properly in the closed position and opens properly in the open position. When the cam moves the valve to its open position, the piston of the air spring moves with the valve, thus reducing the volume of the air chamber and as a result increasing the air pressure therein. When the cam no longer pushes down on the valve, the air pressure inside the air chamber causes the piston of the air spring to return to its initial position and to return the valve to its closed position.

Air springs do not resonate at high engine speeds the way metallic coil springs do. Also, for equivalent spring forces, air springs are lighter than metallic coil springs. Furthermore, air springs have progressive spring rates, which means that the spring force of an air spring varies non-linearly depending on the position of the piston inside the cylinder of the air spring, which may also be advantageous for certain engines.

Although air springs offer many advantages over metallic coil springs, they also have some deficiencies that need to be addressed.

One of these deficiencies is that air can leak out of the air springs when the engine is not in use. When the air pressure inside the air springs becomes too low, this causes the valves to move to their opened positions. When this occurs and the engine is started, the pistons of the engine can come into contact with the valves. Even if the engine is not in use, the piston may still come into contact with the valves, for example if the crankshaft is caused to rotate as a result of towing or otherwise transporting the vehicle. The impact of the piston on the valve can potentially damage the valve, for example by dislodging the shim or the cotter from their intended positions. As a result, the operation of the valve is impaired, possibly preventing operation of the engine.

One possible solution consists in providing metallic coil springs having a relatively low spring constant in addition to the air springs. The metallic coil springs are strong enough to bias the valves towards their closed position even when the air pressure inside the air springs is no longer sufficient to do so on its own. However, these metallic coil springs do not provide enough biasing force to return the valves to their closed position fast enough while the engine is in operation. Although the addition of these metallic coil springs will prevent the pistons of the engine from coming into contact with the valves when the engine is started, they add weight and complexity to the air spring system. The additional metallic coil springs can also lead to some resonance as the speed of the engine increases.

Therefore, there is a need for an air spring assembly having a construction that maintains a secure connection between the various components thereof.

SUMMARY OF THE INVENTION

It is an object of the present invention to ameliorate at least some of the inconveniences present in the prior art.

It is also an object of the present invention to provide an air spring having a cap that maintains the valve stem, cotter and shim in position relative to the piston.

In one aspect, the invention provides a poppet valve assembly, comprising a housing. A poppet valve has a valve head and a valve stem extending away from the valve head. The valve stem has a central longitudinal axis. A portion of the valve stem is received in the housing. A piston is disposed at least in part in the housing. The piston is capable of reciprocating motion relative to the housing along a reciprocation axis coaxial with the central longitudinal axis. The piston has a valve-receiving portion. The valve-receiving portion defines an aperture for receiving therein an end portion of the valve stem opposite the valve head. The piston and the housing define an air chamber therebetween. At least one air port fluidly communicates with the air chamber to supply air to the air chamber. A cotter is disposed between the valve-receiving portion and the end portion. The cotter secures the valve stem to the piston such that the piston and the poppet valve reciprocate together along the reciprocation axis. A cap is disposed generally around at least a portion of the valve-receiving portion. The cap has a cap end portion disposed at least in part over the aperture to form a generally flat abutment surface adapted to be contacted by a valve actuator of an internal combustion engine. A cap lateral portion extends away from the cap end portion generally in the direction of the valve head. At least one part of the valve-receiving portion is held between at least part of the cap end portion and at least part of the cap lateral portion in a direction generally parallel to the reciprocation axis.

In a further aspect, a shim is disposed at least in part in the aperture. The shim is disposed between the valve stem and the cap end portion in the direction generally parallel to the reciprocation axis.

In a further aspect, the housing includes a cylinder and a valve stem guide. The piston reciprocates in the cylinder. At least a portion of the valve stem reciprocates in the valve stem guide.

In a further aspect, the at least one air port is a single air port.

In a further aspect, the air port communicates the interior of the air chamber with an air compressor via an air supply line.

In a further aspect, air in the air chamber biases the piston in a direction away from a bottom of the housing.

In a further aspect, the piston is biased in the direction away from the bottom of the housing only by air in the air chamber.

In an additional aspect, the invention provides a poppet valve assembly, comprising a housing. A poppet valve has a valve head and a valve stem extending away from the valve head. The valve stem has a central longitudinal axis. A portion of the valve stem is received in the housing. A piston is disposed at least in part in the housing. The piston is capable of reciprocating motion relative to the housing along a reciprocation axis coaxial with the central longitudinal axis. The piston has a valve-receiving portion. The valve-receiving portion defines an aperture for receiving therein an end portion of the valve stem opposite the valve head. The piston and the housing define an air chamber therebetween. At least one air port fluidly communicates with the air chamber to supply air to the air chamber. A cotter is disposed between the valve-receiving portion and the end portion. The cotter secures the valve stem to the piston such that the piston and the poppet valve reciprocate together along the reciprocation axis. A cap is disposed generally around at least a portion of the valve-receiving portion. The cap has a cap end portion disposed at least in part over the aperture to form a generally flat abutment surface adapted to be contacted by a valve actuator of an internal combustion engine. A cap lateral portion extends away from the cap end portion generally in the direction of the valve head. At least part of the cap lateral portion is angled toward the reciprocation axis. The part of the cap lateral portion is closer to the reciprocation axis than at least part of the valve-receiving portion.

In a further aspect, a shim is disposed at least in part in the aperture. The shim is disposed between the valve stem and the cap end portion in the direction generally parallel to the reciprocation axis.

In a further aspect, the air spring housing includes a cylinder and a valve stem guide. The piston reciprocates in the cylinder. At least a portion of the valve stem reciprocates in the valve stem guide.

In a further aspect, the at least one air port is a single air port.

In a further aspect, the air port communicates the interior of the air chamber with an air compressor via an air supply line.

In a further aspect, air in the air chamber biases the piston in a direction away from a bottom of the housing.

In a further aspect, the piston is biased in the direction away from the bottom of the housing only by air in the air chamber.

In an additional aspect, the invention provides a method of assembling a poppet valve assembly. A valve stem of a poppet valve is inserted in an air spring housing. The valve stem is inserted through a valve-receiving portion of a piston. At least one cotter is disposed between an end portion of the valve stem and the valve-receiving portion of the piston. The valve-receiving portion of the piston is inserted in a cap. The cap has a generally flat cap end portion facing generally away from the end portion of the valve stem. A lateral surface extends away from the cap end portion generally in the direction of a valve head of the valve, such that at least a part of the valve-receiving portion is held between the at least one portion of the lateral surface and the cap end portion.

In a further aspect, a shim is disposed in the valve-receiving portion in abutting relation with the end portion of the valve stem prior to inserting the valve-receiving portion of the piston in the cap. The cap end portion faces generally away from the shim.

In a further aspect, disposing a cotter between an end portion of the valve stem and the valve-receiving portion of the piston includes disposing a tapered portion of the cotter in abutting relation with a tapered recess in the valve-receiving portion of the piston.

In a further aspect, at least one portion of the lateral surface is deformed radially inwardly toward the valve stem after inserting the valve-receiving portion of the piston in the cap.

In a further aspect, deforming at least one portion of the lateral surface includes deforming the at least one portion into contact with a tapered portion of the valve-receiving portion of the piston.

In a further aspect, inserting the valve-receiving portion of the piston in the cap includes resiliently deflecting the at least one portion of the lateral surface radially outwardly away from the valve stem. The at least one portion of the lateral surface is resiliently deflected radially inwardly toward the valve stem after inserting the valve-receiving portion of the piston in the cap.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 2:
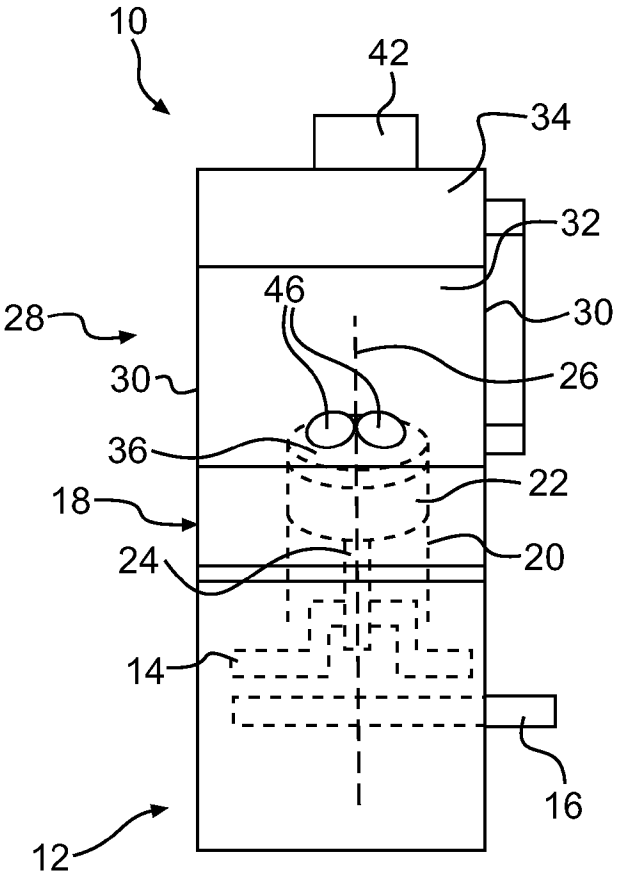
FIG. 2 is an end elevation view of the engine of FIG. 1.
Figure 1:
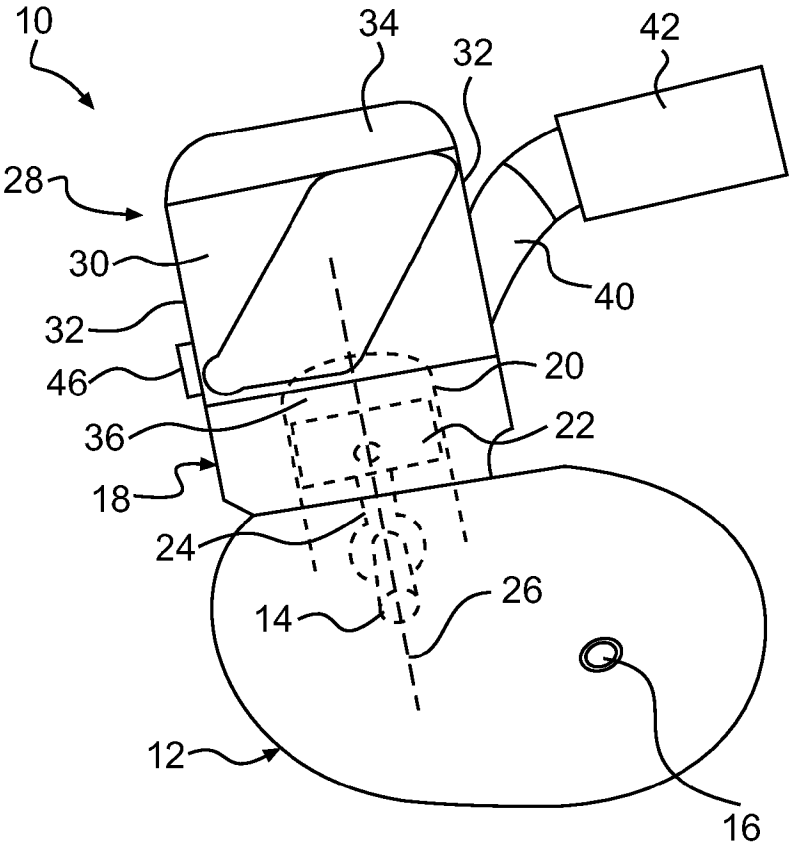
FIG. 1 is a side elevation view of an internal combustion engine according to the present invention.

An internal combustion engine 10 in accordance with the present invention will be described with reference to FIGS. 1 to 3. The engine 10 operates on the four-stroke principle, however it is contemplated that aspects of the present invention could be used on engines operating on other principles and having intake and/or exhaust valves. The engine 10 has a crankcase 12. The crankcase 12 houses a crankshaft 14 and an output shaft 16. The output shaft 16 is operatively connected to the crankshaft 14 via a transmission (not shown) also housed in the crankcase 12. The output shaft 16 extends out of the crankcase 12 to transmit power from the engine 10 to an element operatively connected to the output shaft 16. In the case where the engine 10 is provided in a wheeled vehicle, such as a motorcycle, the output shaft 16 is operatively connected to the wheels of the vehicle to transmit power from the engine 10 to the wheels. It is contemplated that the engine 10 could be used in other types of vehicles, such as a snowmobile, or in other types of applications.

A cylinder block 18 is connected to the crankcase 12. The cylinder block 18 defines a cylinder 20. A piston 22 is disposed inside the cylinder 20. The piston 22 is connected by a connecting rod 24 to the crankshaft 14. During operation of the engine 10, the piston 22 reciprocates inside the cylinder 20 along a cylinder axis 26 defined by the cylinder 20, thus driving the crankshaft 14, which drives the output shaft 16 via the transmission. It is contemplated that the cylinder block 18 could define more than one cylinder 20, and, as a result, the engine 10 would have a corresponding number of pistons 22 and associated parts. It is also contemplated that the engine could be a V-type engine having two cylinder blocks 18.

A cylinder head 28 is connected to the cylinder block 18. The cylinder head 28 has two side walls 30, two end walls 32, and a cylinder head cover 34. The cylinder head 28, the cylinder 20, and the piston 22 define a variable volume combustion chamber 36 of the engine 10 therebetween.

Figure 3:
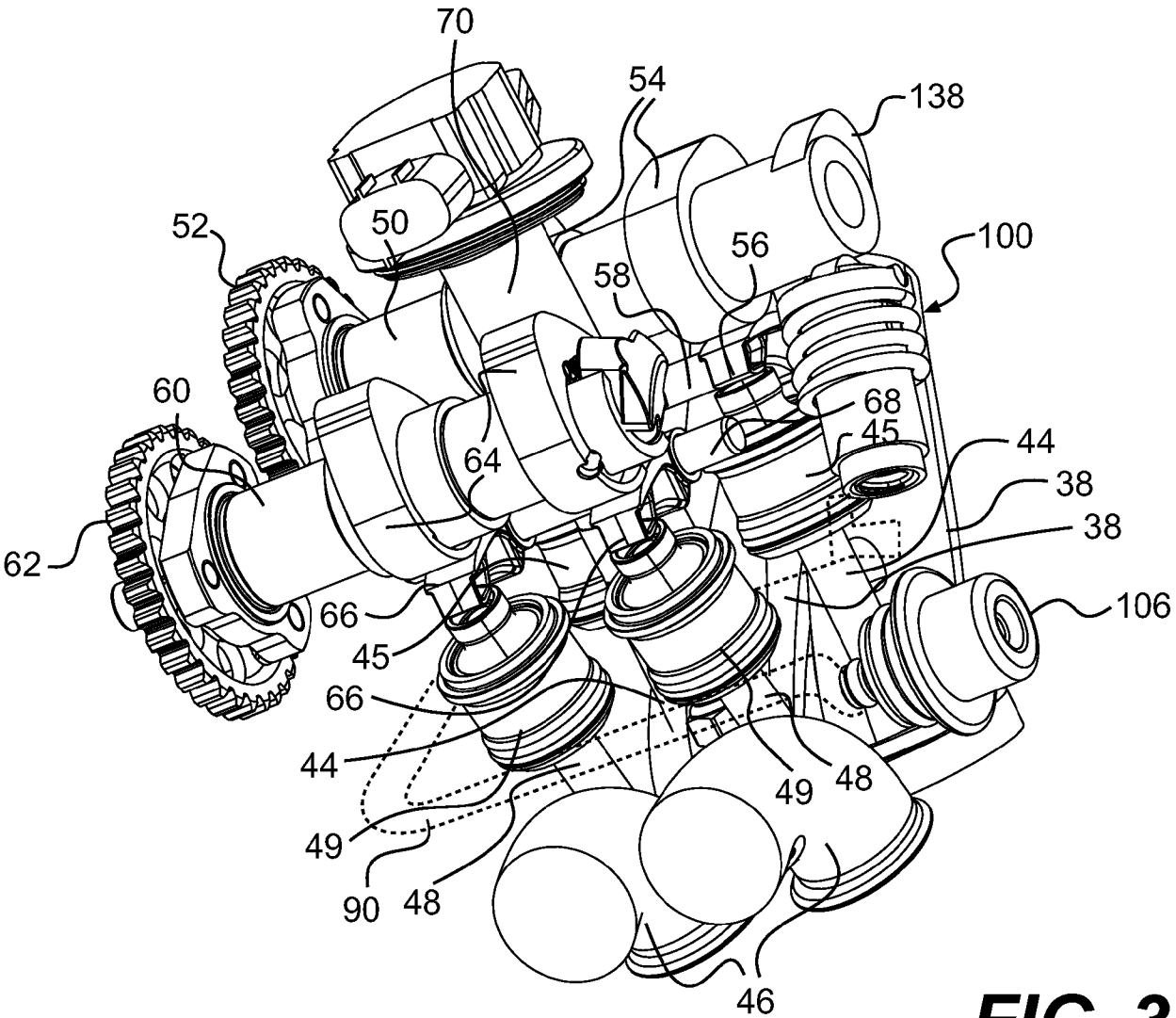
FIG. 3 is a perspective view of internal components of a cylinder head of the engine of FIG. 1.

As seen in FIG. 3, two air intake passages 38 are provided in the cylinder head 28. One end of each air intake passage 38 is connected to the combustion chamber 36, and the other end of each air intake passage 38 is connected to a corresponding outlet of an air intake manifold 40 (FIG. 1) having a single inlet. A carburetor 42 (FIG. 1) is connected to the inlet of the air intake manifold 40. The carburetor 42 controls the flow of air and fuel that enters the combustion chamber 36 via the air intake passages 38. It is contemplated that the carburetor 42 could be replaced by a throttle body that only controls the flow of air to the combustion chamber 36, in which case a fuel injector in communication with the combustion chamber 36 would be provided in the engine 10. Each air intake passage 38 is provided with an intake valve 44 that is movable between an opened position and a closed position to allow or prevent, respectively, air and fuel to enter the combustion chamber 36 as described in greater detail below. Each intake valve 44 is provided with an air spring 45 that biases the intake valve 44 toward its closed position.

Two exhaust passages 46 are provided in the cylinder head 28. One end of each exhaust passage 46 is connected to the combustion chamber 36, and the other end of each exhaust passage 46 is connected to a corresponding inlet of an exhaust manifold (not shown) having a single outlet. The outlet of the exhaust manifold is connected to an exhaust system of the engine 10 which releases the exhaust gases from the engine 10 to the atmosphere. Each exhaust passage 46 is provided with an exhaust valve 48 that is movable between an opened position and a closed position to allow or prevent, respectively, exhaust gases to exit the combustion chamber 36 as described in greater detail below. Each exhaust valve 48 is provided with an air spring 49 that biases the exhaust valve 48 toward its closed position.

It is contemplated that there may be only one, or more than two, of each of the air intake and exhaust passages 38, 46 with a corresponding number of intake and exhaust valves 44, 48 and associated elements. It is also contemplated that there may be a different number of air intake and exhaust passages 38, 46. For example, it is contemplated that there could be two air intake passages 38 and a single exhaust passage 46. Also, although it is preferred that each of the valves 44, 48 be provided with an air spring 45 or 49, it is contemplated that only some of the valves 44, 48 (or only one of the valves 44, 48 should there be only one intake valve 44 and/or one exhaust valve 48) could be provided with an air spring 45 or 49.

An intake camshaft 50 is disposed in the cylinder head 28 generally parallel to a rotation axis of the crankshaft 14. A sprocket 52 is disposed at one end of the intake camshaft 50. A chain (not shown) operatively connects the sprocket 52 to a sprocket (not shown) operatively connected to the crankshaft 14, such that the intake camshaft 50 is driven by the crankshaft 14. Two intake cams 54 (one per intake valve 44) are disposed on the intake camshaft 50. Each intake cam 54 engages a corresponding valve actuator in the form of a intake cam follower 56 rotatably disposed on an intake cam follower shaft 58. Each air spring 45 is biased against its corresponding intake cam follower 56, such that, as the intake camshaft 50 rotates, each intake cam 54 pushes on its corresponding intake cam follower 56, which in turn pushes on its corresponding air spring 45 and moves the corresponding intake valve 44 to the opened position. As the intake camshaft 50 continues to rotate, each air spring 45 returns the corresponding intake valve 44 to its closed position.

An exhaust camshaft 60 is disposed in the cylinder head 28 generally parallel to the intake camshaft 50. A sprocket 62 is disposed at one end of the exhaust camshaft 60. A chain (not shown) operatively connects the sprocket 62 to a sprocket (not shown) operatively connected to the crankshaft 14, such that the exhaust camshaft 60 is driven by the crankshaft 14. Two exhaust cams 64 (one per exhaust valve 48) are disposed on the exhaust camshaft 60. Each exhaust cam 64 engages a corresponding valve actuator in the form of exhaust cam follower 66 rotatably disposed on an exhaust cam follower shaft 68. Each air spring 49 is biased against its corresponding exhaust cam follower 66, such that, as the exhaust camshaft 60 rotates, each exhaust cam 64 pushes on its corresponding exhaust cam follower 66, which in turn pushes on its corresponding air spring 49 and moves the corresponding exhaust valve 48 to the opened position. As the exhaust camshaft 60 continues to rotate, each air spring 49 returns the corresponding exhaust valve 48 to its closed position.

It is contemplated that the cam followers 56, 66, and the cam follower shafts 58, 68 could be omitted and that the cams 54, 64 could engage the air springs 45, 49 and valves 44, 48 directly, in which case the cams 54, 64 would be the valve actuators. It is also contemplated that the cam followers 56, 66 could be replaced by rocker arms. It is also contemplated that each cam 54, 64 could engage more than one valve 44, 48. It is also contemplated that there could be only one camshaft having both the intake and exhaust cams 54, 64 disposed thereon. It is also contemplated that the shape of the cams 54, 64 could be different from the one illustrated in the figures depending on the type of engine performance that is desired.

A spark plug 70 (FIG. 1) is disposed between the camshafts 50 and 60 and extends inside the combustion chamber 36 to ignite the air fuel mixture inside the combustion chamber 36.

Figure 4:
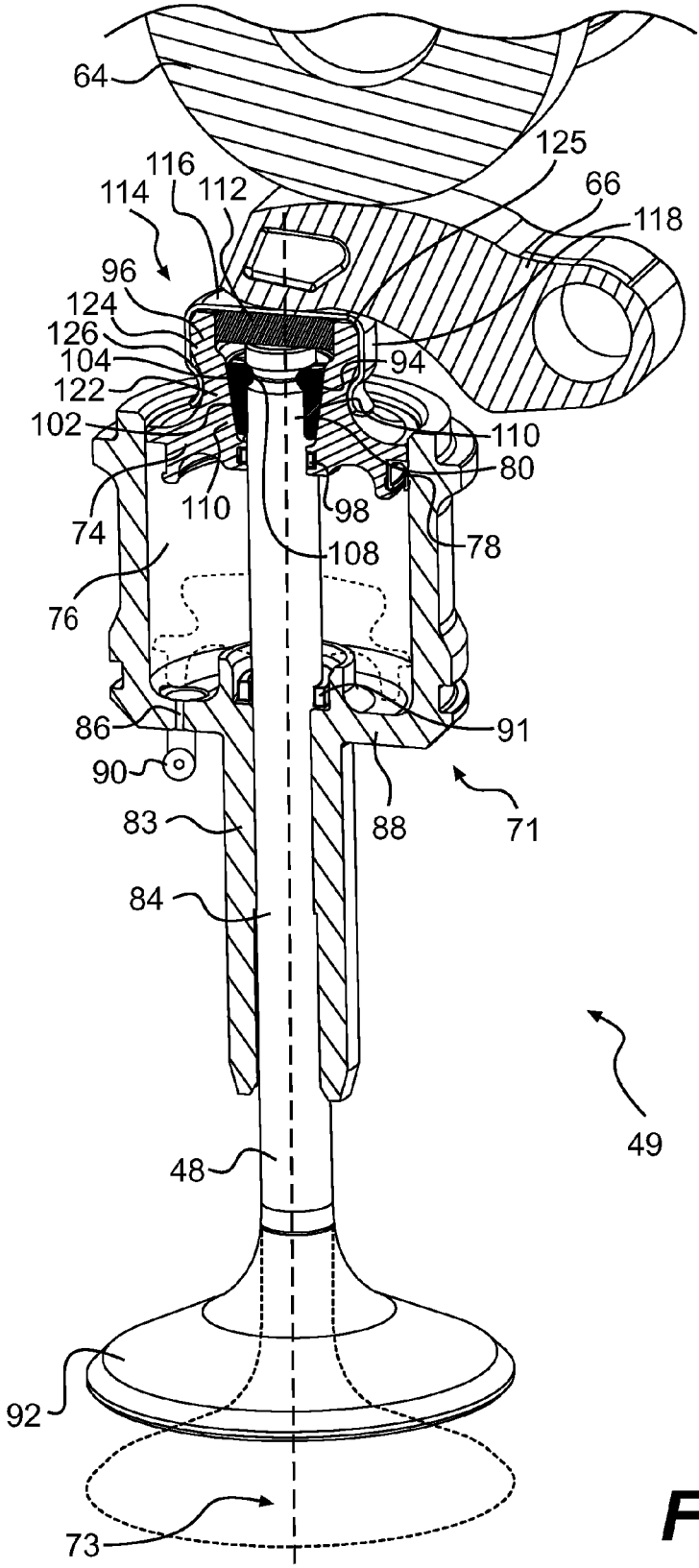
FIG. 4 is partial cross-sectional view of a valve, air spring, and camshaft assembly of the engine of FIG. 1, with a cap according to a first embodiment of the invention.

Turning now to FIG. 4, one of the air springs 49 will be described in more detail. The other air spring 49 and the air springs 45 have the same construction and as such will not be described in detail herein.

A housing 71 of the air spring 49 consists of a cylinder 72 and a valve stem guide 82. A piston 74 is disposed at least in part inside the cylinder 72, and reciprocates therein along the reciprocation axis 73 when actuated by the exhaust cam 64, between a first position (shown in FIG. 4) corresponding to the valve 48 being in a closed position and a second position (shown in phantom in FIG. 4) corresponding to the valve 48 being in an open position. The cylinder 72 and the piston 74 define therebetween an air chamber 76. The air in the air chamber 76 is preferably at a pressure of about 6.5 bar when the piston 74 is in the first position, and about 30 bar when the piston 74 is in the second position, though it should be understood that these pressures may vary depending on the specific application for which the air spring 49 is intended. The pressure in the air chamber 76 when the piston 74 is in the second position should be sufficient to return the piston 74 to the first position, and the pressure in the air chamber 76 when the piston 74 is in the first position should be sufficient to bias the piston 74 away from the bottom 88 of the cylinder 72 to maintain the piston 74 in the first position. A seal 78 is provided between the piston 74 and the cylinder 72 to discourage the escape of air from the air chamber 76. An air port 86 is formed in the bottom 88 of the cylinder 72. The air port 86 is connected to an air supply line 90 used to supply air to the air chamber 76 of the air spring 49 to replenish the air lost due to leakage and thereby maintain the desired pressure in the air chamber 76. An appropriate air pressure is maintained in the air supply line 90 by a compressor 100 (FIG. 3) driven by the camshaft 60 to supply air to the air supply line 90 and a pressure release valve 106 to prevent the pressure in the air supply line 90 from exceeding the desired value.

A portion of the valve stem 84 is received in the valve stem guide 82 to make sure the valve 48 moves in a straight line along the central longitudinal axis of the valve stem 84, which is coaxial with the reciprocation axis 73. The valve 48 reciprocates along with the piston 74. The open and closed positions of the valve 48 correspond respectively to the open and closed positions of the piston 74. A seal 91 is placed around the valve stem 84 to prevent leakage of air from the air chamber 76 around the valve stem 84.

The end 80 of the valve stem 84 opposite the valve head 92 is inserted through the cylinder 72, and into a valve-receiving aperture 94 formed in a valve-receiving portion 96 of the piston 74. A seal 98 between the piston 74 and the valve stem 84 prevents leakage of air from the air chamber 76 around the valve stem 84. A cotter 102, preferably formed of two halves, is placed around the end 80 of the valve stem 84, and held in place via an inward annular protrusion 104 received in a corresponding annular recess 108 in the end 80 of the valve stem 84. The outer surface 110 of the cotter 102 is tapered, and cooperates with a correspondingly tapered shape of the interior of the aperture 94. A shim 112 is inserted into the aperture 94 and abuts the end 80 of the valve stem 84. The thickness of the shim 112 is selected so that the valve 48 will properly prevent exhaust gases from exiting the combustion chamber 36 when in the closed position and allow exhaust gases to exit the combustion chamber 36 when in the open position. It is contemplated that the shim 112 may be omitted if the valve stem 84 is machined precisely to the desired length, however this approach entails additional machining expenses due to the precision required. A cap 114 preferably made of hardened steel, which will be described below in further detail, is placed around the valve-receiving portion 96 of the piston 74 to hold the shim 112, the valve stem 84, and the cotter 102 in position, as well as to provide a generally flat abutment surface for the cam follower 66.

Figure 5:
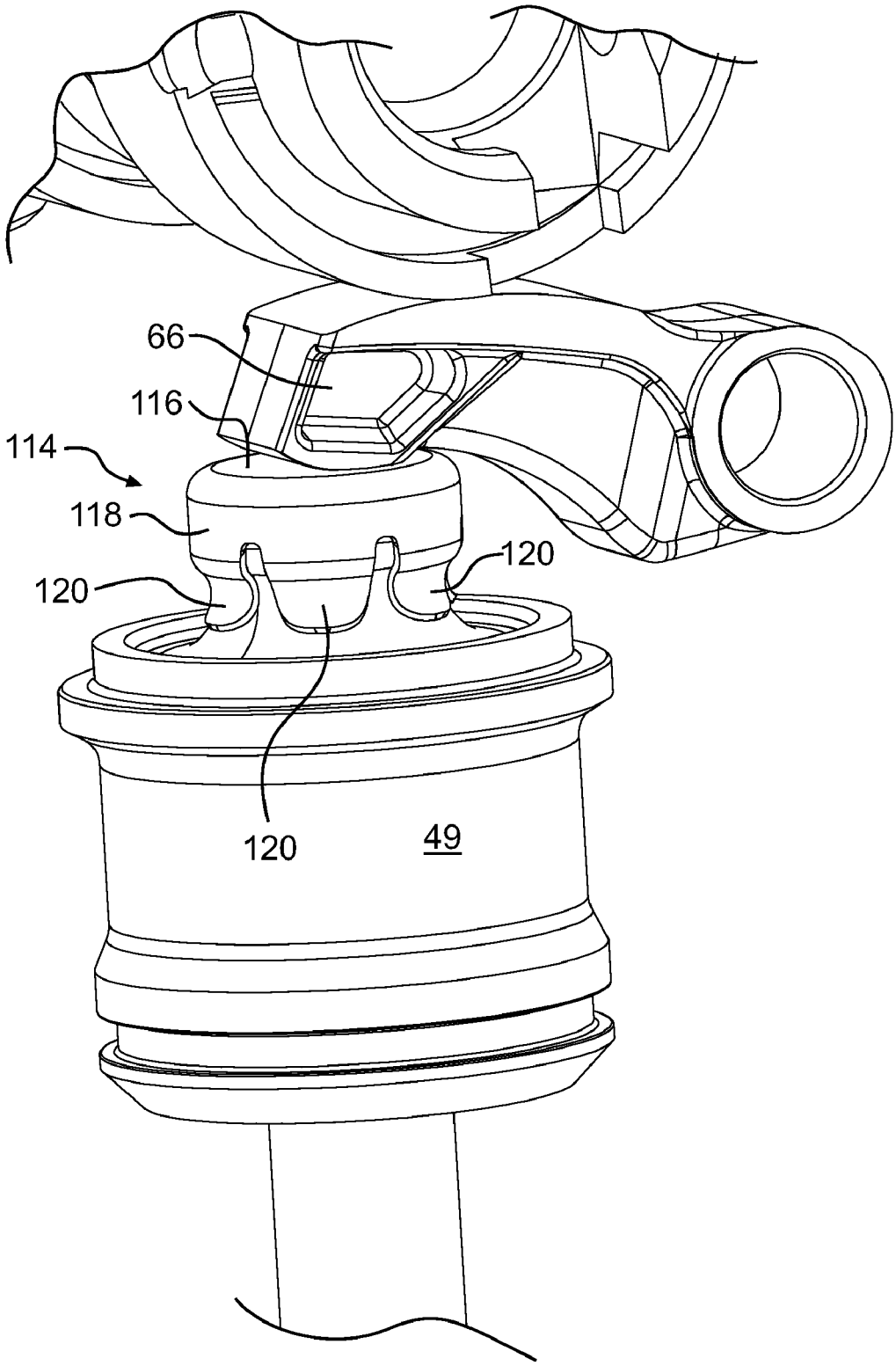
FIG. 5 is a perspective view of view of an air spring and camshaft assembly of the engine of FIG. 1, with the cap of FIG. 4.
Figure 6:
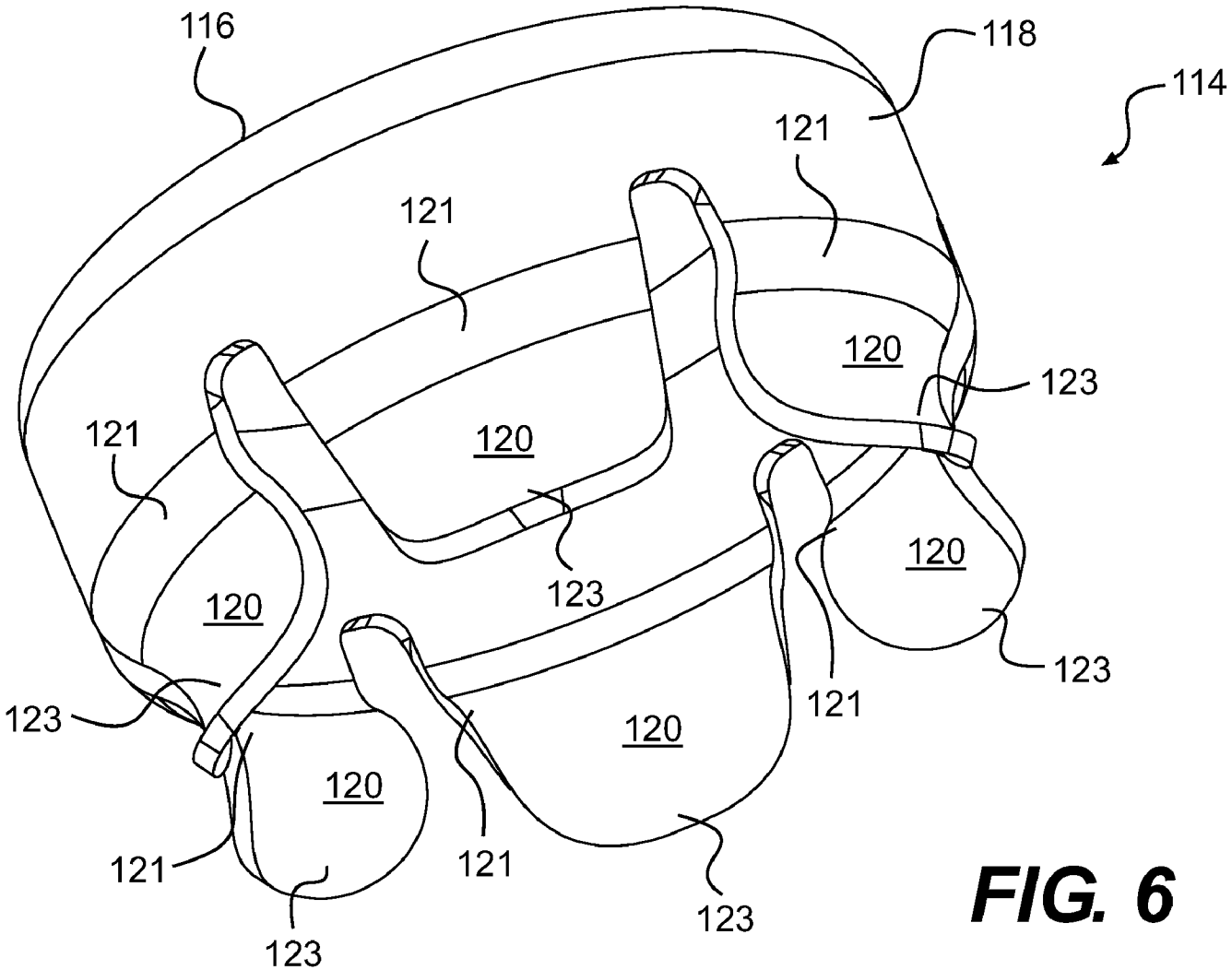
FIG. 6 is a perspective view of the cap of FIG. 4.

Referring to FIGS. 5 and 6, the cap 114 will be described according to a first embodiment. An end portion 116 of the cap 114 is generally flat and faces generally away from the end 80 of the valve stem 84 as seen in FIG. 4. The end portion 116 covers the aperture 94 to form an abutment surface for the cam follower 66. A lateral portion 118 of the cap 114 extends away from the end portion 116 generally in the direction of the valve head 92. The lateral portion 118 includes six tabs 120 (three of which are shown in FIG. 5) extending generally away from the end portion 116 and generally in the direction of the valve head 92, though it is contemplated that more or fewer tabs 120 may be used. Each tab 120 is formed with a portion 121 angled radially inwardly and away from the end portion 116, and a portion 123 angled radially outwardly and away from the end portion 116. As seen in FIG. 4, the valve-receiving portion 96 of the piston 74 has a narrow part 122 with a width W1, and a wide part 124 with a width W2 greater than W1, and a tapered region 126 therebetween. The wide part 124 is generally between the narrow part 122 and the end portion 116 of the cap 114. The valve-receiving portion 96 is inserted into the cap 114 by snapping the cap 114 over the end of the valve-receiving portion 96 with the application of sufficient force in the direction generally along the axis 73. The tabs 120 are resiliently deflected radially outwardly as they pass over the wide part 124, and they deflect radially inwardly upon encountering the narrow part 122. The valve-receiving portion 96 preferably has an angled or rounded upper edge 125 that cooperates with the angled portion 123 of the cap 112 to deflect the tabs 120 radially outwardly when the valve-receiving portion 96 is inserted into the cap 114. The tabs 120 are disposed generally around the narrow part 122. The angled portion 121 of each tab 120 contacts the tapered region 126 and holds the valve-receiving portion 96 between the end portion 116 and the tabs 120 to maintain the cap 114 in position. The end portion 116 of the cap 114 maintains the shim 112 and the cotter 102 in position within the aperture 94. It should be understood that the cap 114 is capable of accommodating shims 112 of varying thickness.

Figure 7:
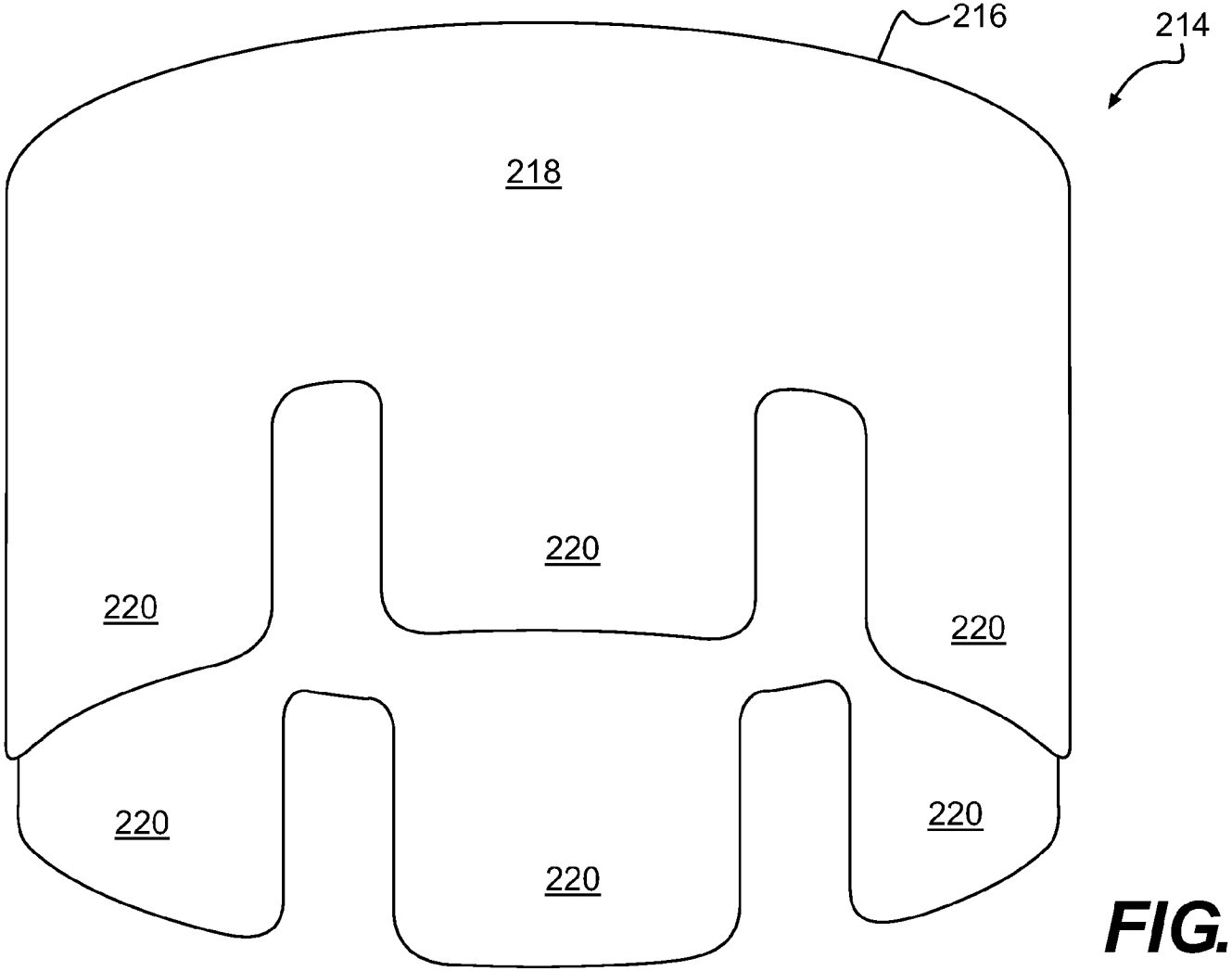
FIG. 7 is a perspective view of a cap, according to a second embodiment.

Referring to FIG. 7, a second embodiment of the cap 114, the cap 214, will be described. The cap 214 has straight tabs 220, unlike the tabs 120 of FIG. 6 which have angled portions 121 and 123. In this embodiment, when the valve-receiving portion 96 is inserted in the cap 214, the tabs 220 are mechanically crimped radially inwardly to form the shape shown in FIG. 5, such that they are closer to the axis 73 than the wide part 124 of the valve-receiving portion 96. The tabs 220 are preferably deformed inwardly until they contact the narrow part 122 of the piston as well as the tapered region of the valve-receiving portion 96. The contact between the tabs 220 and the valve-receiving portion 96 of the piston 74 maintains the cap 214 in position, such that the end portion 216 of the cap 214 maintains the shim 112 and the cotter 102 in position within the aperture 94.

Figure 8:
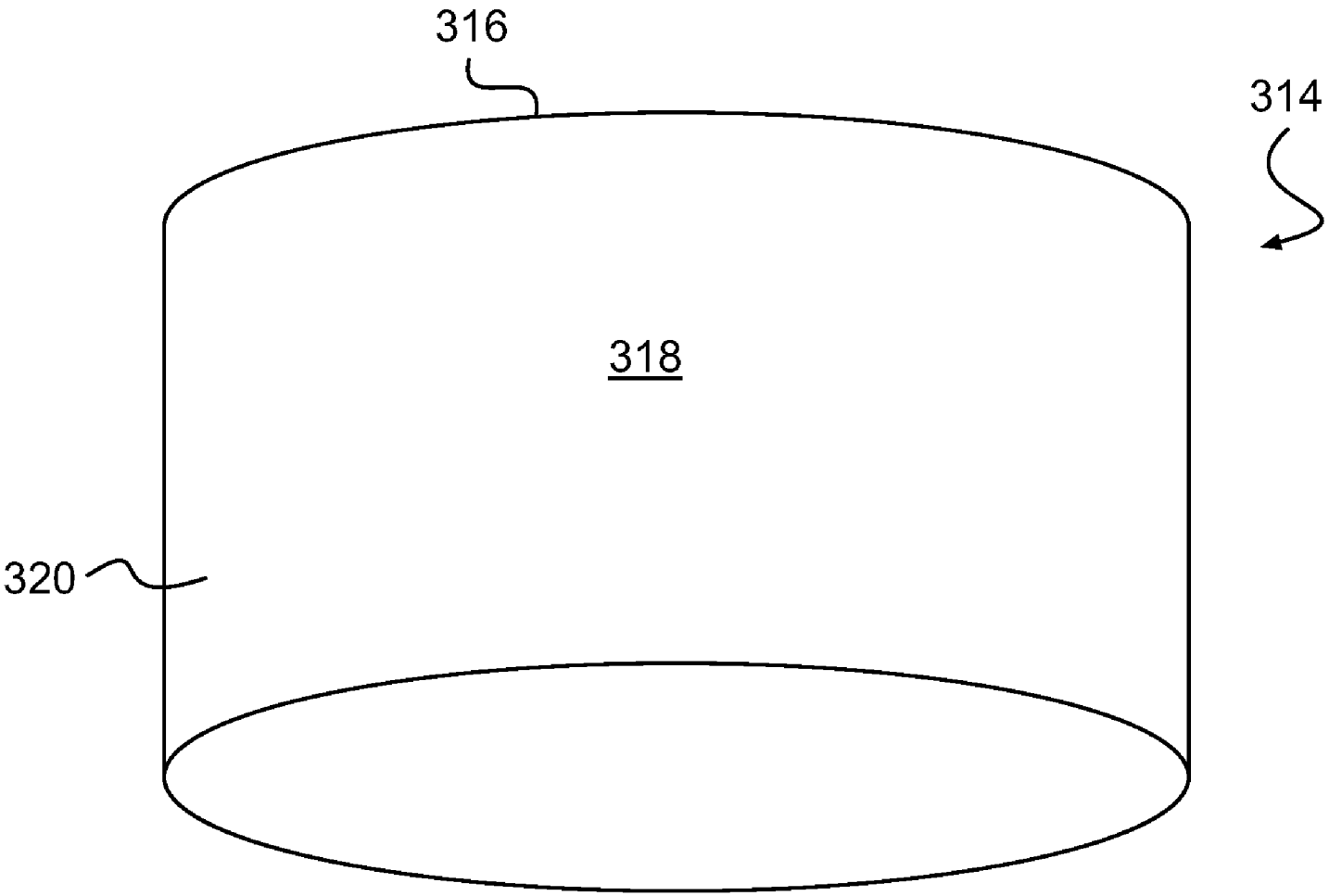
FIG. 8 is a perspective view of a cap according to a third embodiment of the invention.
Figure 9:
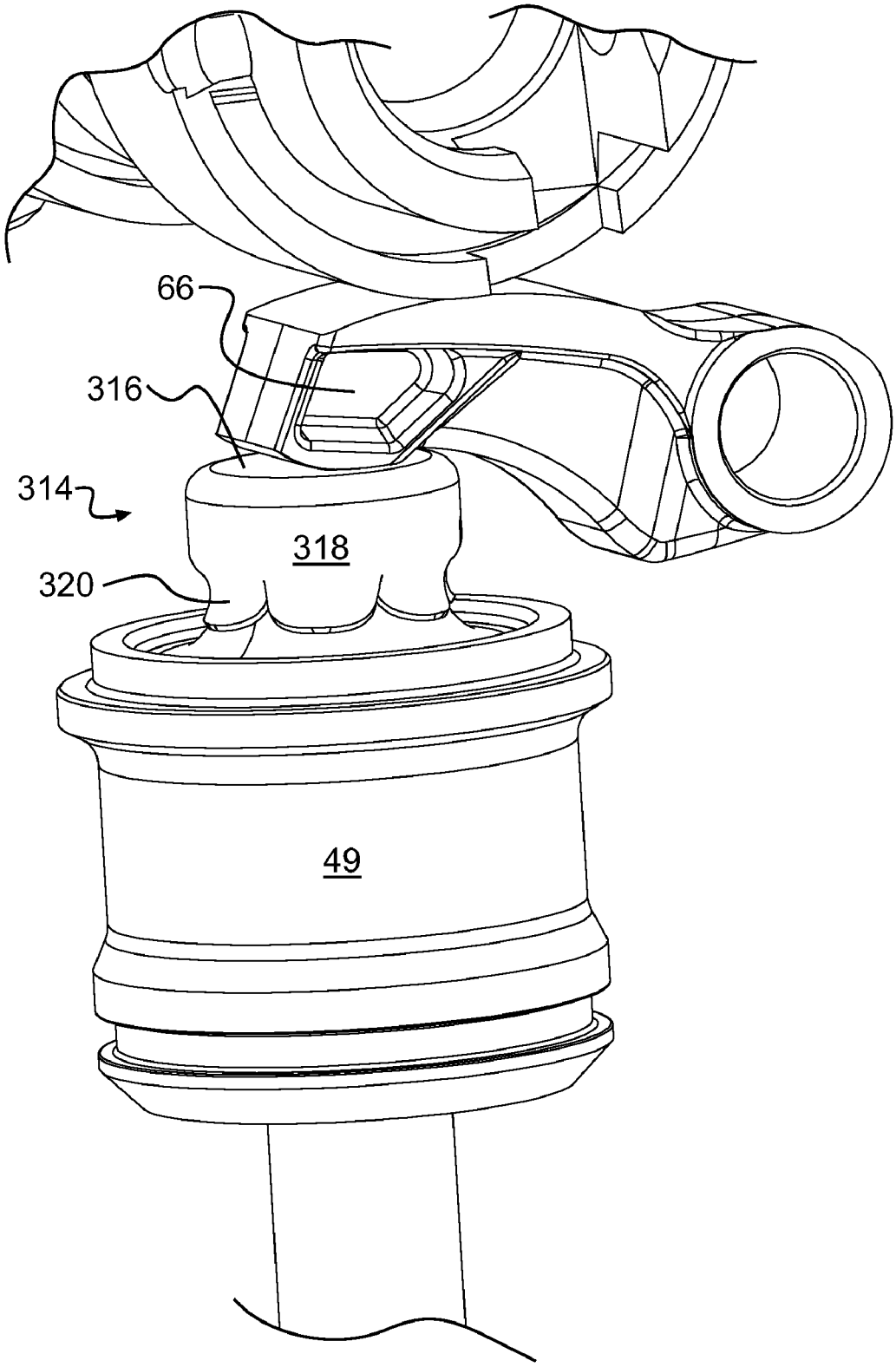
FIG. 9 is a perspective view of view of an air spring and camshaft assembly of the engine of FIG. 1, with the cap of FIG. 8.

Referring to FIGS. 8 and 9, a third embodiment of the cap 114, the cap 314, will be described The cap 314 is generally similar in structure and function to the cap 214 of FIG. 7, with the exception that the end 320 of the lateral portion 318 of the cap 314 opposite the end portion 316 extends continuously around the circumference of the cap 314, rather than having a number of tabs. The end 320 is disposed generally around the narrow part 122 of the piston 74. When the valve-receiving portion 96 is inserted in the cap, the end 320 is crimped and deformed radially inwardly, as seen in FIG. 9, such that at least a portion of the end 320 is closer to the axis 73 than the wide part 124 of the valve-receiving portion 96. The end 320 is preferably deformed to angle inwardly until it contacts the narrow part 122 of the piston 74 as well as the tapered region 126 of the valve-receiving portion 96. The contact between the end 320 and the valve-receiving portion 96 of the piston 74 maintains the cap 314 in position, such that the end portion 316 of the cap 314 maintains the shim 112 and the cotter 102 in position within the aperture 94.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A poppet valve assembly, comprising:

a housing;

a poppet valve having a valve head and a valve stem extending away from the valve head, the valve stem having a central longitudinal axis, a portion of the valve stem being received in the housing;

a piston disposed at least in part in the housing, the piston being capable of reciprocating motion relative to the housing along a reciprocation axis coaxial with the central longitudinal axis, the piston having a valve-receiving portion, the valve-receiving portion defining an aperture for receiving therein an end portion of the valve stem opposite the valve head, the piston and the housing defining an air chamber therebetween;

at least one air port fluidly communicating with the air chamber to supply air to the air chamber;

a cotter disposed between the valve-receiving portion and the end portion, the cotter securing the valve stem to the piston such that the piston and the poppet valve reciprocate together along the reciprocation axis; and a cap disposed generally around at least a portion of the valve-receiving portion, the cap having:

a cap end portion disposed at least in part over the aperture to form a generally flat abutment surface adapted to be contacted by a valve actuator of an internal combustion engine; and a cap lateral portion extending away from the cap end portion generally in the direction of the valve head, at least one part of the cap lateral portion being angled toward the reciprocation axis and being closer to the reciprocation axis than at least part of the valve-receiving portion, at least one part of the valve-receiving portion being disposed and held in a direction generally parallel to the reciprocation axis between at least part of the cap end portion and the at least one part of the cap lateral portion being angled toward the reciprocation axis.

2. The poppet valve assembly of claim 1, further comprising a shim disposed at least in part in the aperture, the shim being disposed between the valve stem and the cap end portion in the direction generally parallel to the reciprocation axis.

3. The poppet valve assembly of claim 2, wherein:

the air spring housing includes a cylinder and a valve stem guide;

the piston reciprocates in the cylinder; and at least a portion of the valve stem reciprocates in the valve stem guide.

4. The poppet valve assembly of claim 3, wherein the at least one air port is a single air port.

5. The poppet valve assembly of claim 4, wherein the air port communicates the interior of the air chamber with an air compressor via an air supply line.

6. The poppet valve assembly of claim 1, wherein air in the air chamber biases the piston in a direction away from a bottom of the housing.

7. The poppet valve assembly of claim 6, wherein the piston is biased in the direction away from the bottom of the housing only by air in the air chamber.

8. A method of assembling a poppet valve assembly, comprising:

inserting a valve stem of a poppet valve in an air spring housing, the valve stem having a central longitudinal axis;

inserting the valve stem through a valve-receiving portion of a piston;

disposing at least one cotter between an end portion of the valve stem and the valve-receiving portion of the piston;

inserting the valve-receiving portion of the piston in a cap, the cap having a generally flat cap end portion facing generally away from the end portion of the valve stem, and a lateral surface extending away from the cap end portion generally in the direction of a valve head of the valve, at least one part of the cap lateral portion being angled toward the central longitudinal axis and being closer to the central longitudinal axis than at least part of the valve-receiving portion, such that at least a part of the valve-receiving portion is disposed and held in a direction generally parallel to the central longitudinal axis between at least part of the cap end portion and the at least one part of the cap lateral portion being angled toward the reciprocation axis.

9. The method of claim 8, further comprising:

disposing a shim in the valve-receiving portion in abutting relation with the end portion of the valve stem prior to inserting the valve-receiving portion of the piston in the cap;

wherein the cap end portion faces generally away from the shim.

10. The method of claim 8, wherein disposing a cotter between an end portion of the valve stem and the valve-receiving portion of the piston includes disposing a tapered portion of the cotter in abutting relation with a tapered recess in the valve-receiving portion of the piston.

11. The method of claim 8, further comprising deforming at least one portion of the lateral surface radially inwardly toward the valve stem after inserting the valve-receiving portion of the piston in the cap to form the at least one part of the cap lateral portion being angled toward the central longitudinal axis.

12. The method of claim 11, wherein deforming at least one portion of the lateral surface includes deforming the at least one portion into contact with a tapered portion of the valve-receiving portion of the piston.

13. The method of claim 8, wherein inserting the valve-receiving portion of the piston in the cap includes:

resiliently deflecting the at least one portion part of the lateral surface radially outwardly away from the valve stem;

the method further comprising resiliently deflecting the at least one portion part of the lateral surface radially inwardly toward the valve stem after inserting the valve-receiving portion of the piston in the cap.

* * * * *